US009004485B2

(12) United States Patent
Lo et al.

(10) Patent No.: US 9,004,485 B2
(45) Date of Patent: Apr. 14, 2015

(54) ACCESS DOOR FOR MEDIA TRAY WITH ROTATIONAL AND TRANSLATIONAL MOVEMENT OF CLEANOUT

(71) Applicant: Hewlett-Packard Development Company, L.P., Houston, TX (US)

(72) Inventors: Kevin Lo, Vancouver, WA (US); Jerrod Houston Tyler, Vancouver, WA (US); Jeffrey Castleberry, Underwood, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/746,004

(22) Filed: Jan. 21, 2013

(65) Prior Publication Data

US 2014/0203499 A1 Jul. 24, 2014

(51) Int. Cl.
*B65H 1/00* (2006.01)

(52) U.S. Cl.
CPC ..... *B65H 1/00* (2013.01)

(58) Field of Classification Search
USPC ..... 271/145
See application file for complete search history.

(56) References Cited

U.S. PATENT DOCUMENTS

| | | | | |
|---|---|---|---|---|
| 5,785,308 | A * | 7/1998 | Flores et al. | 271/9.11 |
| 6,075,958 | A | 6/2000 | Gotoh et al. | |
| 6,120,201 | A * | 9/2000 | McKay et al. | 400/691 |
| 6,125,251 | A * | 9/2000 | Shiraishi et al. | 399/124 |
| 6,293,718 | B1 | 9/2001 | Osmus | |
| 7,346,294 | B2 | 3/2008 | Lee | |
| 8,087,658 | B2 | 1/2012 | Ohtsuki | |
| 2008/0205914 | A1 | 8/2008 | Jeon | |
| 2010/0247140 | A1 * | 9/2010 | Kikuchi et al. | 399/111 |
| 2012/0304437 | A1 | 12/2012 | Murray et al. | |

FOREIGN PATENT DOCUMENTS

| | | | |
|---|---|---|---|
| JP | 2005-082307 | A | 3/2005 |
| JP | 2005-162492 | A | 6/2005 |

* cited by examiner

*Primary Examiner* — Michael McCullough
*Assistant Examiner* — Howard Sanders
(74) *Attorney, Agent, or Firm* — Patent Law Group LLP

(57) ABSTRACT

Embodiments of the invention include a media tray for a media advance mechanism. The media tray includes an access door attached to the media tray via a hinge oriented in a vertical direction and a cleanout disposed on an interior surface of the access door. The access door pivots open around the hinge. The cleanout is mounted such that the cleanout can move translationally along the access door.

18 Claims, 3 Drawing Sheets

ACCESS DOOR FOR MEDIA TRAY WITH ROTATIONAL AND TRANSLATIONAL MOVEMENT OF CLEANOUT

TECHNICAL FIELD

The present disclosure is related to a media tray including an access door that pivots around a hinge and a cleanout mounted on the access door that moves translationally along the access door.

BACKGROUND

A number of devices are provided with a media advance mechanisms for causing a media such as paper, fabric, cardboard or the like to advance through the apparatus in order to perform some operation on the media. The media advance mechanism of an inkjet printer, for example, causes a printing media such as a sheet or web of paper, textile or other substrate to travel in an advance direction through a print zone, where a printhead deposits ink on the media in successive swaths.

Because media can occasionally become jammed as it is being advanced through the printing apparatus, a cleanout member is provided in many printers. Typically an inner side of the cleanout member faces a portion of the media path. The cleanout member is often removably mounted on the printing apparatus. If a media jam occurs, the user can remove the cleanout member to view and gain access to the jammed media. By manually taking hold of the jammed media, the user can remove it. The cleanout member is then reinstalled onto the printing apparatus and the printing job can continue. Reinstallation of a removable cleanout member can be non-intuitive, which can be a source of frustration to the user during reinstallation.

DETAILED DESCRIPTION

Figure 1:
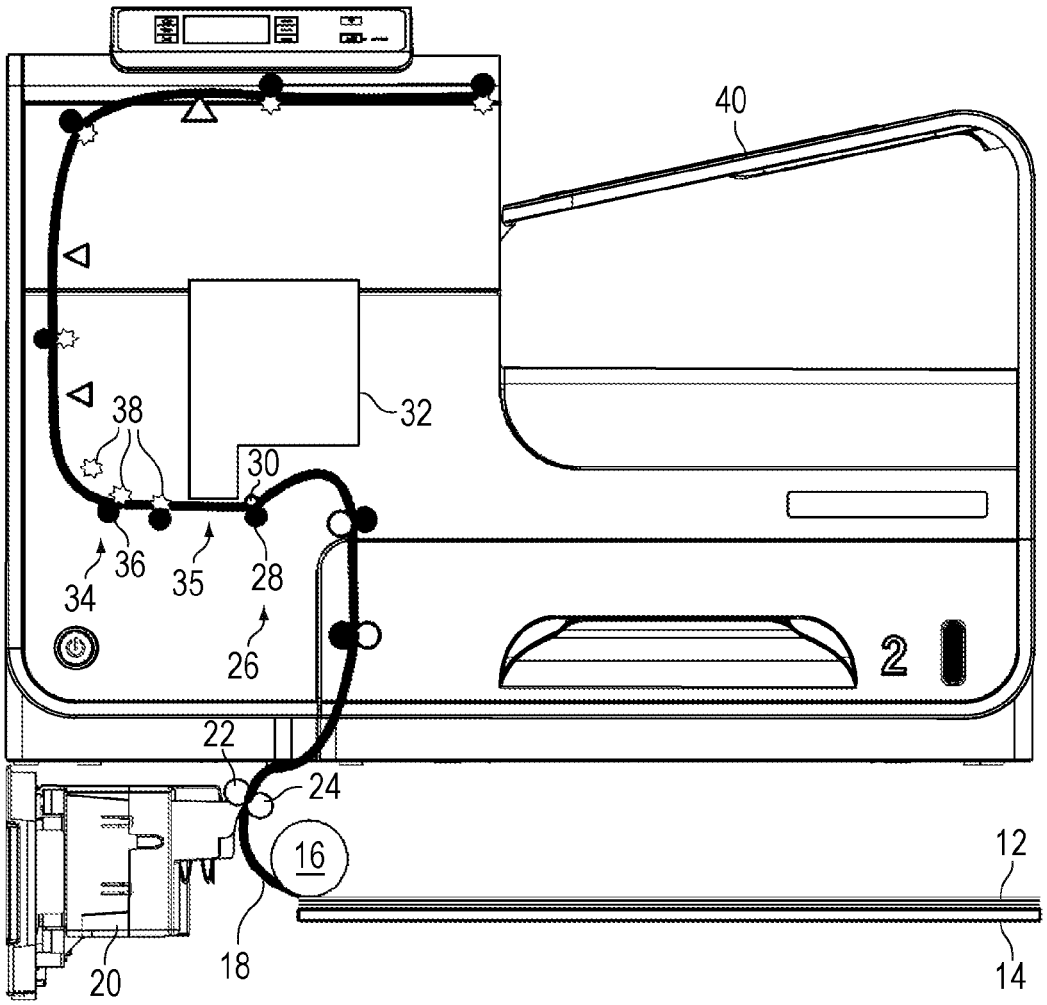
FIG. 1 is a simplified schematic drawing showing in cross section the arrangement of some elements of a media advance mechanism.

FIG. 1 is a simplified view of one example of a media advance mechanism of a printer. Media 12, which may be, for example, sheets of paper or any other suitable media, are stored on a substrate 14. Substrate 14 may be, for example, incorporated into a removable or slidable drawer or tray that is removed from the printer, loaded with media, and replaced in the printer. A pick roller 16 is driven to rotate in a direction that advances the top sheet of media 12 in the forward direction 18. The media enters or passes along an edge of cleanout 20. The edge of cleanout 20 may be curved to match the path 18 of media 12. A pinch roller 22 and turn roller 24 advance the media through or past cleanout 20.

An input driving device 26 and an output driving device or overdrive 34 drive the media through the print zone 35 of the printer. The input driving device 10 is arranged at the media inlet of the printer, upstream of the print zone 35 where ink is deposited on the media from a print head 32, while the output driving device 34 is arranged downstream of the print zone 35.

The input driving device 26 may comprise for example a grit roller 28 and a plurality of pinch rollers 30 spanning the width of the media, the media being engaged between the grit roller 28 and the pinch rollers 30, while in the output driving device 34 the media is engaged between several sets of rubber rollers 36 and star wheels 38, placed at intervals across the width of the media, with the rubber rollers 36 underneath the media and the star wheels 38 in contact with the printed surface. After printing, the media is deposited in a tray 40. FIG. 1 illustrates one example of an arrangement of some components in a printer—any suitable structures may be used.

Figure 2:
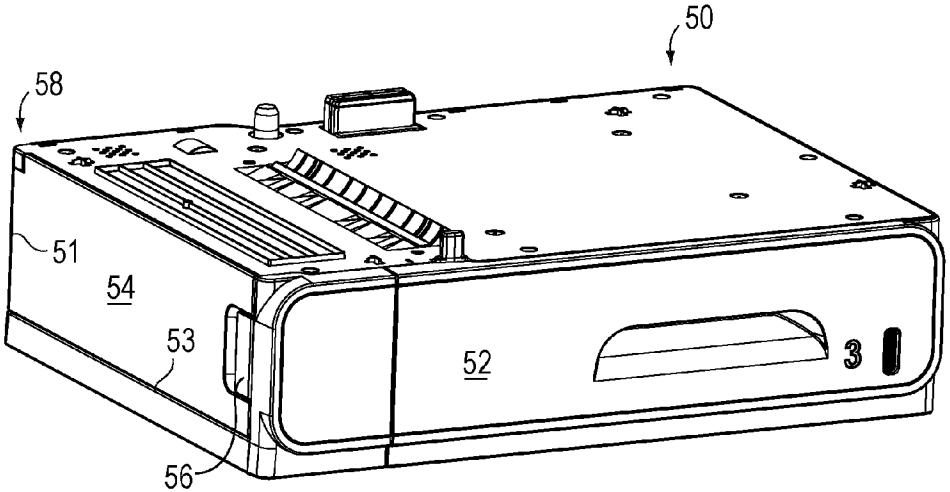
FIG. 2 illustrates an accessory tray.

FIG. 2 illustrates an accessory tray 50 for a printer. Accessory tray 50 stores media and supplies media to a media advance mechanism. Accessory tray 50 includes a front access door 52 and a side access door 54. The front access door 52 is substantially perpendicular to the side access door 54. Front access door 52 may be opened to load media. Side access door 54 may be opened to access a cleanout to clear media jams. A latch 56 releases side access door 54 and allows side access door 54 to open by pivoting around axis 58. A variety of types of latches and catches can be used to secure the side access door 54 in its closed position. In the example illustrated in FIG. 2, latch 56 includes a projection formed on or attached to one end of side access door 54 which seats in a hole formed in a portion of the wall of accessory tray 50. In the example illustrated in FIG. 2, side access door 54 is substantially rectangular with two short vertical sides 51 and two long horizontal sides 53. Hinge 58 is disposed on one of the short sides and latch 56 is disposed on the other of the short sides.

Figure 3:
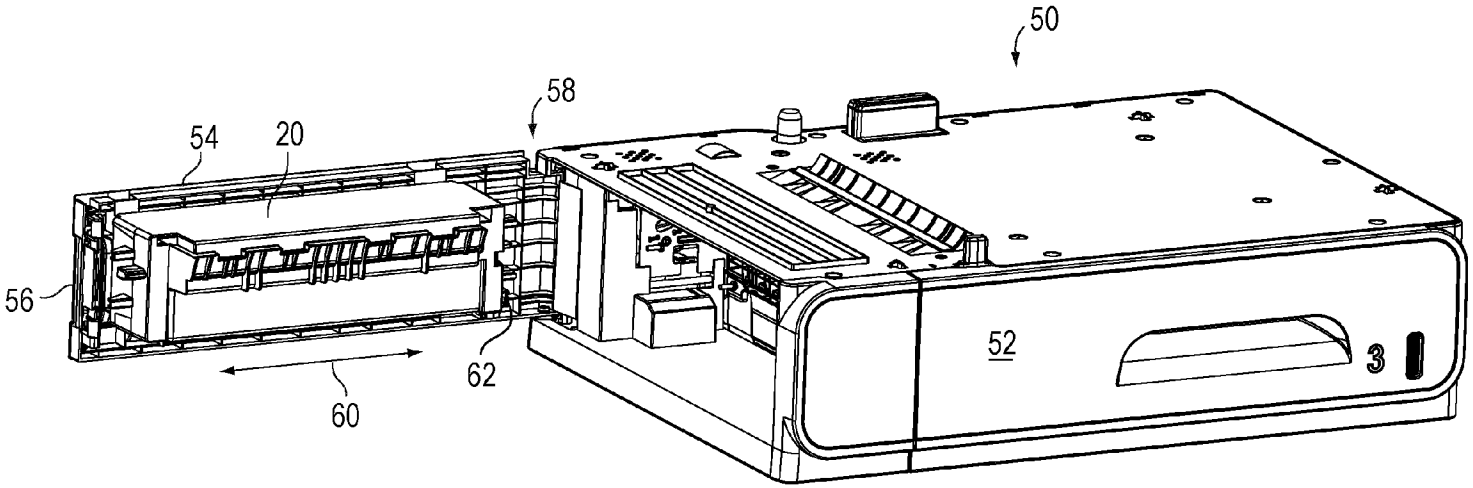
FIG. 3 illustrates the accessory tray of FIG. 2 with a side access door opened.

FIG. 3 illustrates the accessory tray 50 with the side access door 54 opened. Cleanout 20 is mounted on the interior surface of side access door 54. Cleanout 20 may be mounted on one or more rails 62 or on any other suitable structure such that cleanout 20 can move translationally side to side in a direction parallel to the long side 53 of side access door 54, as indicated by direction arrows 60. Cleanout 20 may move translationally in direction 60 automatically as side access door 54 swings open. Alternatively, translational movement of cleanout 20 may be initiated by a user. In some examples, as side access door 54 swings open, cleanout 20 slides toward hinge 58. As side access door 54 swings closed, cleanout 20 slides toward latch 56.

Figure 4A:
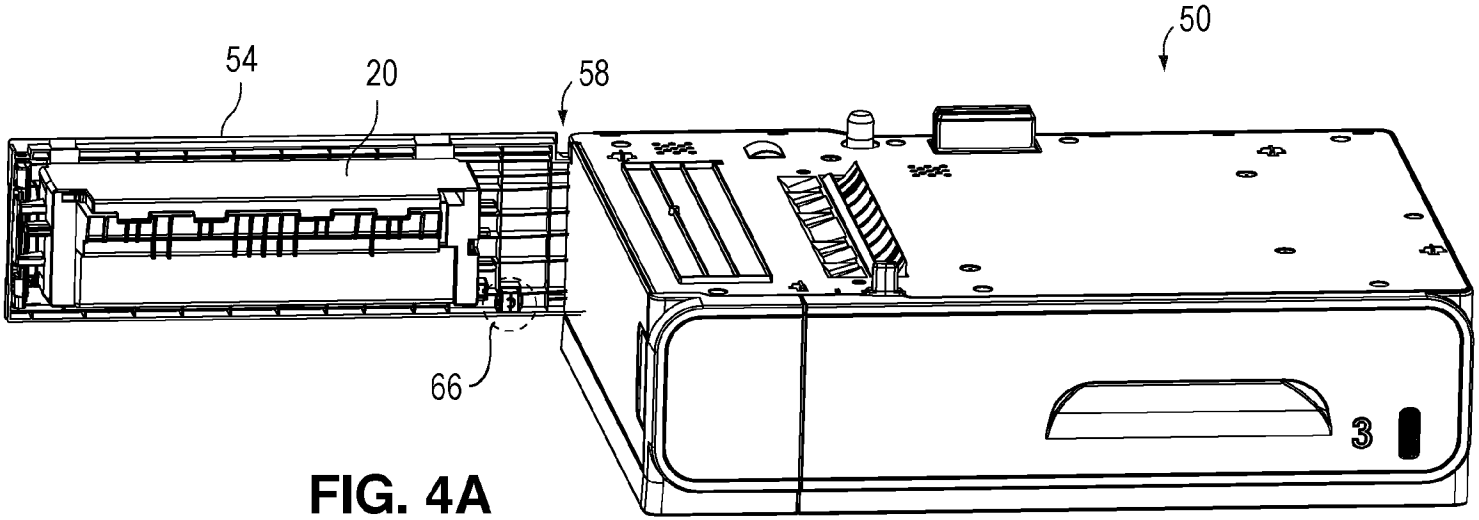
FIGS. 4A and 4B illustrate a plunger that pushes the side access door outward.
Figure 4B:
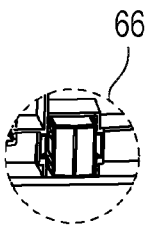

FIG. 4A illustrates a plunger 66 disposed on the interior of side access door 54. FIG. 4B illustrates plunger 66 in more detail. When latch 56 is released by a user, plunger 66 pushes side access door 54 open such that side access door 54 rotates around axis 58. When a user closes side access door 54 by pushing side access door 54 back into accessory tray 50 and engaging latch 56, plunger 66 opposes the motion, such that the user is in effect pushing against plunger 66 to close side access door 54.

The action of plunger 66 may reduce the number of sensors required in the side access door 54. A magnetic sensor indicates that cleanout 20 is in the media path. A separate sensor to indicate that side access door 54 is latched is not required, because as long as cleanout 20 is in the media path, side access door 54 must be latched, because if side access door is not latched, plunger 66 would push side access door 54 open, thus removing cleanout 20 from the media path.

Figure 5:
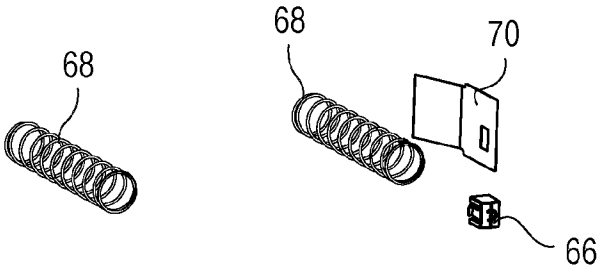
FIG. 5 illustrates the relative arrangement of springs that push the cleanout into the media path, a leaf spring that pushes the cleanout translationally when the side access door is opened, and the plunger illustrated in FIGS. 4A and 4B.

FIG. 5 illustrates the relative arrangement of several parts disposed on side access door 54. Springs 68 are disposed between cleanout 20 and the interior surface of side access door 54. Springs 68 push cleanout 20 into the media path when the side access door 54 is closed. Leaf spring 70 engages with cleanout 20 on the side of cleanout 20. When side access door 54 is opened, leaf spring 70 causes cleanout 20 to slide along rails 62 toward hinge 58, effectively reducing the radius of the arc followed by the cleanout 20. When side access port 54 is closed, guide surfaces on the interior of accessory tray 50 cause cleanout 20 to slide along rails 62 toward latch 56 and into leaf spring 70, effectively increasing the radius of the arc followed by cleanout 20. In other words, leaf spring 70 causes cleanout 20 to retract when access door 54 is opened, and structures in the interior of accessory tray 50 push cleanout 20 back into position when access door 54 is closed. Travel stops in the track where cleanout 20 slides on either side of cleanout 20 limit the travel of cleanout 20 in either direction. Plunger 66 pushes side access door 54 open when latch 56 is released, as described above.

In order to clear a media jam, the user presses latch 56 of FIG. 2 to open side access door 54. As illustrated in FIGS. 2 and 3, side access door 54 swings open in an arc around hinge 58. As side access door 54 swings open, leaf spring 70 slides cleanout 20 along rail 62 toward hinge 58. The user removes the media and closes side access door 54 by pushing side access door 54 until latch 56 engages. As side access door 54 swings closed, leaf spring 70 slides cleanout 20 along rails 62 toward latch 56. Plunger 66 pushes again side access door 54 as the user pushes side access door 54 closed until latch 56 engages. Springs 68 push cleanout 20 into the media path when side access door 54 is closed by engaging latch 56.

The devices and methods described herein have the advantage of not relying on a user to correctly remove and replace the cleanout to clear media jams. The devices and methods described herein are particularly useful for media trays where the media path is deeply imbedded in the accessory.

Various other adaptations and combinations of features of the examples disclosed are within the scope of the invention. The present disclosure describes an example of a media advance mechanism. The devices and methods to access a cleanout to remove media jams described by the present disclosure may be used with other media advance mechanisms, or with other systems that require alignment of media. Numerous examples are encompassed by the following claims.

What is claimed is:

1. A media tray for a media advance mechanism, the media tray comprising:

an access door attached to the media tray via a hinge oriented in a vertical direction, wherein the access door pivots open around the hinge;

a cleanout attached to an interior surface of the access door, wherein the cleanout is attached such that the cleanout can move translationally along the access door; and a spring disposed proximate a side of the cleanout, wherein the spring pushes the cleanout translationally along the access door when the access door is opened.

2. The media tray of claim 1, further comprising a latch disposed on the access door, wherein the latch secures the access door closed.

3. The media tray of claim 2, further comprising a plunger positioned to push the access door open when the latch is released.

4. The media tray of claim 1, further comprising springs disposed between the cleanout and the interior surface of the access door, wherein the springs push the cleanout into a media path in the media advance mechanism when the access door is closed.

5. The media tray of claim 1, further comprising a structure within the media tray, wherein the structure pushes the cleanout translationally along the access door when the access door is closed.

6. The media tray of claim 1, wherein the cleanout is attached to a rail mounted on the interior surface of the access door, wherein the cleanout is attached to the rail such that the cleanout can slide along the rail.

7. The media tray of claim 1, wherein the access door comprises a short side and a long side, wherein the hinge is disposed on the short side and translational movement of the cleanout is substantially parallel to the long side.

8. The media tray of claim 1, wherein the access door is a first access door, the media tray comprising a second access door perpendicular to the first access door.

9. A method comprising:

pivoting an access door in a media tray for a media advance mechanism open around a vertically-oriented hinge; and sliding a cleanout attached to an interior surface of the access door in a direction perpendicular to the hinge including sliding the cleanout translationally along the access door using a spring disposed proximate a side of the cleanout when the access door is opened.

10. The method of claim 9, wherein sliding a cleanout comprises sliding the cleanout toward the hinge as the access door pivots open.

11. The method of claim 10, wherein sliding a cleanout comprises sliding the cleanout away from the hinge as the access door pivots closed.

12. A media tray for a media advance mechanism, the media tray comprising:

an access door attached to the media tray via a hinge oriented in a vertical direction, wherein the access door pivots open around the hinge;

a cleanout attached to an interior surface of the access door, wherein the cleanout is attached such that the cleanout can move translationally along the access door; and springs disposed between the cleanout and the interior surface of the access door, wherein the springs push the cleanout into a media path in the media advance mechanism when the access door is closed.

13. The media tray of claim 12, further comprising a latch disposed on the access door, wherein the latch secures the access door closed.

14. The media tray of claim 13, further comprising a plunger positioned to push the access door open when the latch is released.

15. The media tray of claim 12, further comprising a structure within the media tray, wherein the structure pushes the cleanout translationally along the access door when the access door is closed.

16. The media tray of claim 12, wherein the cleanout is attached to a rail mounted on the interior surface of the access door, wherein the cleanout is attached to the rail such that the cleanout can slide along the rail.

17. The media tray of claim 12, wherein the access door comprises a short side and a long side, wherein the hinge is disposed on the short side and translational movement of the cleanout is substantially parallel to the long side.

18. The media tray of claim 12, wherein the access door is a first access door, the media tray comprising a second access door perpendicular to the first access door.

* * * * *